US007527181B1

(12) United States Patent
Sullivan

(10) Patent No.: US 7,527,181 B1
(45) Date of Patent: May 5, 2009

(54) GLOVE DONNING SYSTEM

(76) Inventor: Steven R. Sullivan, 166 Academy Oaks Pl., Altamonte Springs, FL (US) 32714

( * ) Notice: Subject to any disclaimer, the term of this patent is extended or adjusted under 35 U.S.C. 154(b) by 0 days.

(21) Appl. No.: 11/801,046

(22) Filed: May 8, 2007

(51) Int. Cl.
*A47G 25/80* (2006.01)

(52) U.S. Cl. ..... 223/111

(58) Field of Classification Search ..... 223/111, 223/112, 120
See application file for complete search history.

(56) References Cited

U.S. PATENT DOCUMENTS

| | | | | |
|---|---|---|---|---|
| 2,443,115 | A * | 6/1948 | Park | 223/111 |
| 3,237,821 | A * | 3/1966 | Hayne et al. | 223/111 |
| 4,002,276 | A * | 1/1977 | Poncy et al. | 223/111 |
| 4,069,913 | A * | 1/1978 | Harrigan | 206/278 |
| 4,159,069 | A * | 6/1979 | Poncy et al. | 223/111 |
| 4,275,812 | A * | 6/1981 | Poncy et al. | 206/278 |
| 4,845,781 | A * | 7/1989 | Strickland et al. | 2/161.6 |
| 4,898,309 | A | 2/1990 | Fischer | |
| 5,924,610 | A * | 7/1999 | Willemin | 223/112 |
| 6,006,355 | A * | 12/1999 | Abts | 2/2.11 |
| 6,193,117 | B1 * | 2/2001 | Poschelk | 223/111 |
| 6,213,360 | B1 * | 4/2001 | Aluisi | 223/111 |
| 6,419,131 | B1 | 7/2002 | Rix | |
| 6,485,467 | B1 * | 11/2002 | Crook et al. | 604/174 |
| 2007/0145086 | A1 * | 6/2007 | Perez | 223/111 |

* cited by examiner

*Primary Examiner*—Shaun R Hurley
*Assistant Examiner*—Andrew W Sutton

(57) ABSTRACT

A support ring has an oval upper edge and an oval lower edge. The lower edge is smaller than the upper edge. A tapering oval sidewall is provided between the upper and lower edges. A flange is formed in the support ring. The flange extends outwardly from the upper edge. A groove is provided in the side wall. The groove is provided essentially midway between, and parallel with, the upper and lower edges. A plurality of similarly sized and shaped ramps are formed in the side wall between the groove and the lower edge.

1 Claim, 3 Drawing Sheets

FIG 1
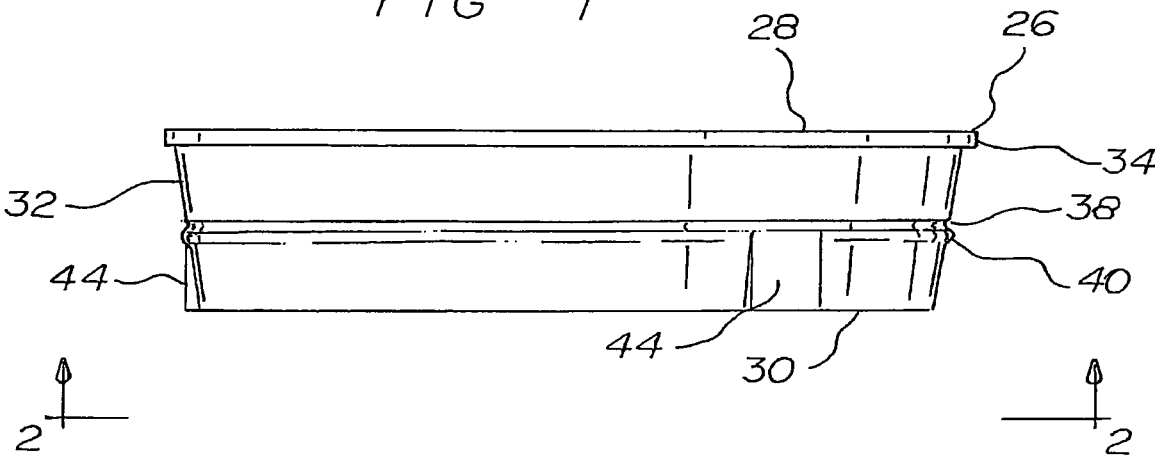
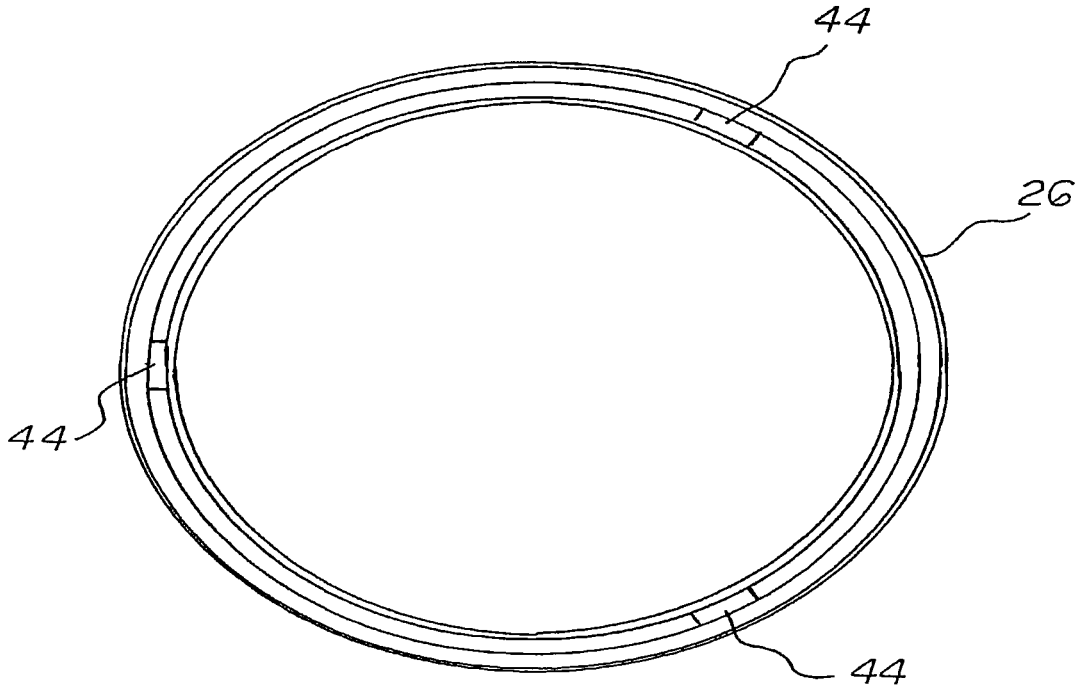
FIG 2

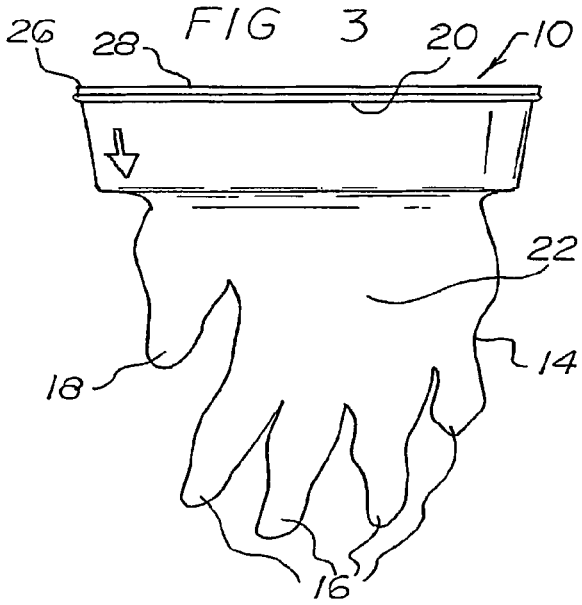
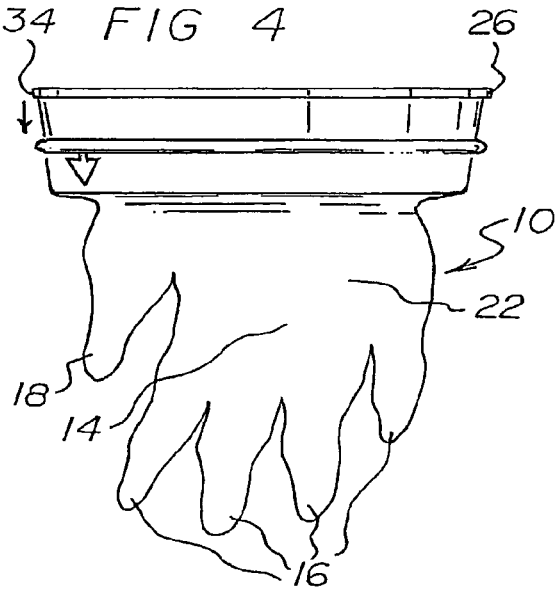
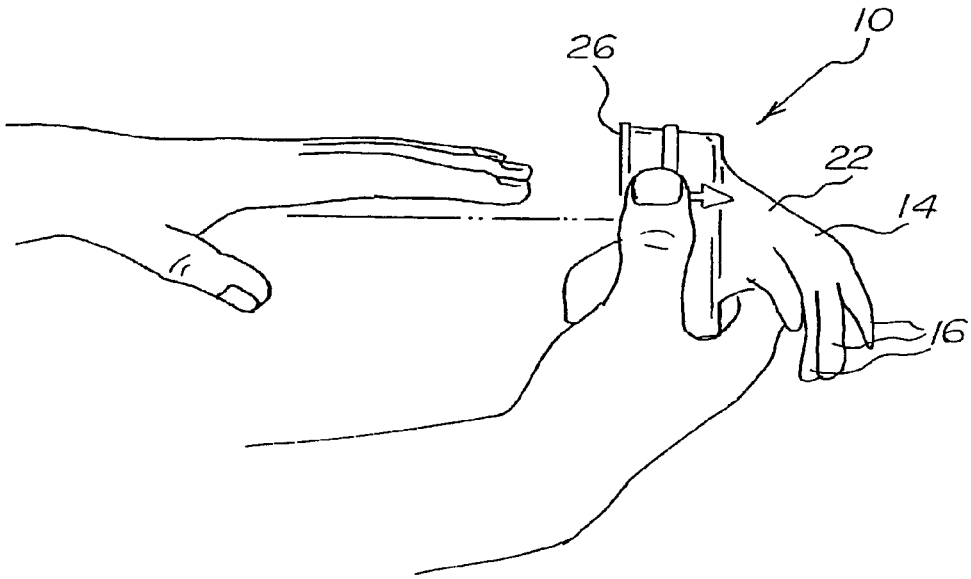
FIG 5

FIG 6
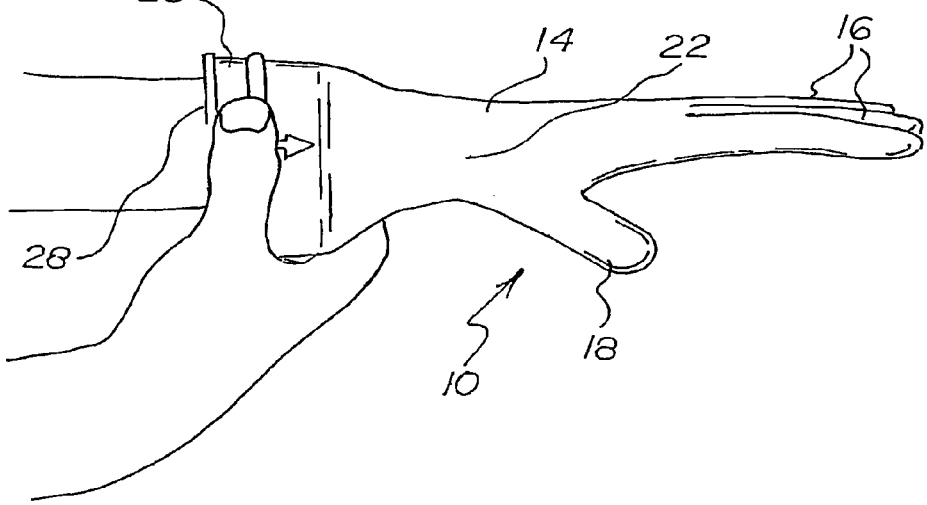
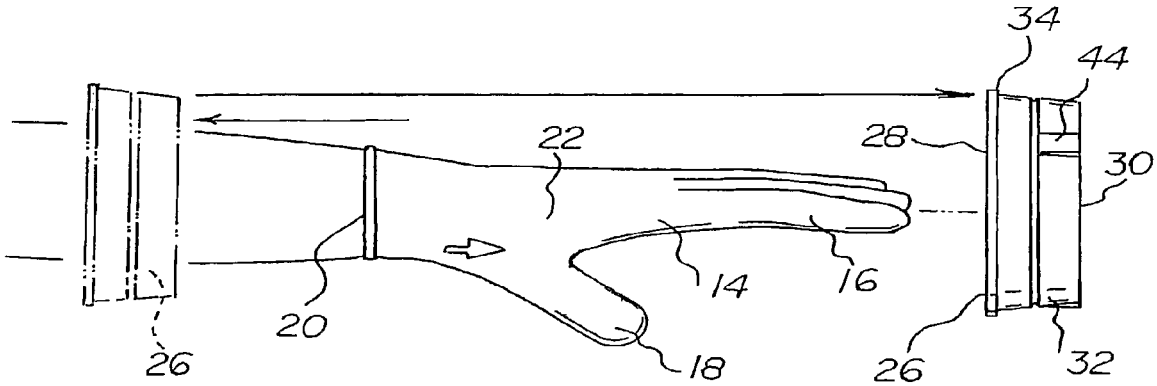
FIG 7

GLOVE DONNING SYSTEM

BACKGROUND OF THE INVENTION

1. Field of the Invention

The present invention relates to a glove donning system and more particularly pertains to facilitating the donning of elastic gloves in a rapid and convenient manner.

2. Description of the Prior Art

The use of glove donning systems of known designs and configurations is known in the prior art. More specifically, glove donning systems of known designs and configurations previously devised and utilized for the purpose of donning gloves through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,419,131 issued Jul. 16, 2002 to Rix relates to a Glove Donning Apparatus and U.S. Pat. No. 4,898,309 issued Feb. 6, 1990 to Fischer relates to an Apparatus to Facilitate the Donning of Elastic Gloves.

While these devices fulfill their respective, particular objectives and requirements, the aforementioned patents do not describe a glove donning system that allows for facilitating the donning of elastic gloves in a rapid and convenient manner.

In this respect, the glove donning system according to the present invention substantially departs from the conventional concepts and designs of the prior art, and in doing so provides an apparatus primarily developed for the purpose of facilitating the donning of elastic gloves in a rapid and convenient manner.

Therefore, it can be appreciated that there exists a continuing need for a new and improved glove donning system which can be used for facilitating the donning of elastic gloves in a rapid and convenient manner. In this regard, the present invention substantially fulfills this need.

SUMMARY OF THE INVENTION

In view of the foregoing disadvantages inherent in the known types of glove donning systems of known designs and configurations now present in the prior art, the present invention provides an improved glove donning system. As such, the general purpose of the present invention, which will be described subsequently in greater detail, is to provide a new and improved glove donning system and method which has all the advantages of the prior art and none of the disadvantages.

To attain this, the present invention essentially comprises a glove donning system. First provided is a pair of elastic gloves. Each glove has a distal end. The distal end has four thin closed finger portions. The finger portions receive the fingers of user. The distal end has a thin closed thumb portion. The thumb portion receives the thumb of a user. Each glove also has a proximal end. The proximal end has a cuff portion. The cuff portion receives the wrist of a user. Each glove has an intermediate portion. The intermediate portion is provided between the distal and proximal ends. The intermediate portion receives the central part of a hand of a user. The hand of a user includes the palm and a back of a hand. The glove is fabricated of an elastic material. The elastic material is selected from the class of elastic materials. The class of elastic materials includes plastic and rubber, natural and synthetic, and blends thereof. The elastic material is preferably latex.

The glove is adapted to stretch over the hand of a user during donning. The glove is adapted to contract over the hand of a user after donning and while being worn.

A support ring is provided. The support ring has an oval upper edge. The oval upper edge is of a first circumference. The support ring has an oval lower edge. The oval lower edge is of a second circumference. The second circumference is less than that of the first circumference. The support ring has a tapering oval sidewall. The tapering oval sidewall is provided between the upper and lower edges. The upper edge has an exterior major diameter. The exterior major diameter of the upper edge is about 4.25 inches. The lower edge has an exterior major diameter. The exterior major diameter of the lower edge is about 4.00 inches. The sidewall has a height. The height of the sidewall is about 1.25 inches.

Provided next is a flange. The flange is formed in the support ring. The flange extends outwardly from the upper edge. The flange is adapted to act as a stop for the proximal edge of the glove. The intermediate portion is in contact with the side wall during a primary positioning of the glove on the support ring prior to donning.

Further provided are generally annular deformations. The deformations are formed contiguously in the side wall. The deformations are provided essentially midway between, and parallel with, the upper and lower edges. The deformations include a groove. The grove is provided above. The deformations include a projection. The projection is provided below. The deformations form an S-shaped cross sectional configuration in the side wall. The deformations have a width. The width of the deformations is about 10 percent of the width of the wall. The deformations are adapted to act as a locating guide for the proximal edge of the glove as it is rolled down during a secondary positioning of the glove on the support ring with the rolled up portion in the groove.

Provided last is a plurality of similarly sized and shaped ramps. The ramps are formed in the side wall. The ramps are provided between the deformations and the lower edge. The ramps are at three equally space locations. The ramps have a circumferential width. The circumferential width of the ramps is about 0.25 inches. Each ramp has a cross sectional configuration of a right triangle. The hypotenuse side of the right triangle is about half the height of the side wall. The longer side of the right triangle is vertical. The shorter side of the right triangle is horizontal. The ramps are adapted to facilitate the retention of the glove on the support ring as well as its removal. The ring with the flange and projection and ramps are integrally fabricated of an essentially rigid material. The essentially rigid material is preferably polyvinyl chloride.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved glove donning system which has all of the advantages of the prior art glove donning systems of known designs and configurations and none of the disadvantages.

It is another object of the present invention to provide a new and improved glove donning system which may be easily and efficiently manufactured and marketed.

It is further object of the present invention to provide a new and improved glove donning system which is of durable and reliable constructions.

An even further object of the present invention is to provide a new and improved glove donning system which is susceptible of a low cost of manufacture with regard to both materials and labor, and which accordingly is then susceptible of low prices of sale to the consuming public, thereby making such glove donning system economically available to the buying public.

Even still another object of the present invention is to provide a glove donning system for facilitating the donning of elastic gloves in a rapid and convenient manner.

Lastly, it is an object of the present invention to provide a new and improved glove donning system. A support ring has an oval upper edge and an oval lower edge. The lower edge is smaller than the upper edge. A tapering oval sidewall is provided between the upper and lower edges. A flange is formed in the support ring. The flange extends outwardly from the upper edge. A groove is provided in the side wall. The groove is provided essentially midway between, and parallel with, the upper and lower edges. A plurality of similarly sized and shaped ramps are formed in the side wall between the groove and the lower edge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a support ring of a glove donning system constructed in accordance with the principles of the present invention.

FIG. 2 is a bottom view of the support ring illustrated in FIG. 2 and taken along line 2-2.

FIG. 3 is a side elevational view similar to FIG. 1 but showing the elastic glove in an initial orientation on the support.

FIG. 4 is a side elevational view similar to FIG. 4 but showing the elastic glove in a final orientation on the support.

FIG. 5 is a side elevational view similar to FIG. 4 but also showing the hands of a user prior to donning a glove.

FIG. 6 is a side elevational view similar to FIG. 5 but showing one hands of a user after donning a glove.

FIG. 7 is a side elevational view similar to FIG. 6 but showing the support ring after removing it from a user.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved glove donning system embodying the principles and concepts of the present invention and generally designated by the reference numeral 10 will be described.

The present invention, the glove donning system 10 is comprised of a plurality of components. Such components in their broadest context include a support ring, a flange, a groove and ramps. Such components are individually configured and correlated with respect to each other so as to attain the desired objective.

First provided is a pair of elastic gloves 14. Each glove has a distal end. The distal end has four thin closed finger portions 16. The finger portions receive the fingers of user. The distal end has a thin closed thumb portion 18. The thumb portion receives the thumb of a user. Each glove also has a proximal end. The proximal end has a cuff portion 20. The cuff portion receives the wrist of a user. Each glove has an intermediate portion 22. The intermediate portion is provided between the distal and proximal ends. The intermediate portion receives the central part of a hand of a user. The hand of a user includes the palm and a back of a hand. The glove is fabricated of an elastic material. The elastic material is selected from the class of elastic materials. The class of elastic materials includes plastic and rubber, natural and synthetic, and blends thereof. The elastic material is preferably latex. The glove is adapted to stretch over the hand of a user during donning. The glove is adapted to contract over the hand of a user after donning and while being worn.

A support ring 26 is provided. The support ring has an oval upper edge 28. The oval upper edge is of a first circumference. The support ring has an oval lower edge 30. The oval lower edge is of a second circumference. The second circumference is less than that of the first circumference. The support ring has a tapering oval sidewall 32. The tapering oval sidewall is provided between the upper and lower edges. The upper edge has an exterior major diameter. The exterior major diameter of the upper edge is about 4.25 inches. The lower edge has an exterior major diameter. The exterior major diameter of the lower edge is about 4.00 inches. The sidewall has a height. The height of the sidewall is about 1.25 inches.

Provided next is a flange 34. The flange is formed in the support ring. The flange extends outwardly from the upper edge. The flange is adapted to act as a stop for the proximal edge of the glove. The intermediate portion is in contact with the side wall during a primary positioning of the glove on the support ring prior to donning.

Further provided are generally annular deformations 38, 40. The deformations are formed contiguously in the side wall. The deformations are provided essentially midway between, and parallel with, the upper and lower edges. The deformations include a groove 38. The grove is provided above. The deformations include a projection 40. The projection is provided below. The deformations form an S-shaped cross sectional configuration in the side wall. The deformations have a width. The width of the deformations is about 10 percent of the width of the wall. The deformations are adapted to act as a locating guide for the proximal edge of the glove as it is rolled down during a secondary positioning of the glove on the support ring with the rolled up portion in the groove.

Provided last is a plurality of similarly sized and shaped ramps 44. The ramps are formed in the side wall. The ramps are provided between the deformations and the lower edge. The ramps are at three equally space locations. The ramps have a circumferential width. The circumferential width of the ramps is about 0.25 inches. Each ramp has a cross sectional configuration of a right triangle. The hypotenuse side of the right triangle is about half the height of the side wall. The longer side of the right triangle is vertical. The shorter side of the right triangle is horizontal. The ramps are adapted to facilitate the retention of the glove on the support ring as well as its removal. The ring with the flange and projection and ramps are integrally fabricated of an essentially rigid material. The essentially rigid material is preferably polyvinyl chloride.

FIGS. 1 and 2 show the beveled bulge on three sides of the ring. This helps to hold the glove in place on the ring before and during application, but allows the glove to slide off easily at the point of release without tearing. Also shown is the overhang or flange at the top of the ring. This insures slip-less grip when stretching the glove for tight fit over fingers. Also shown is the relatively shallow groove with very smooth, beveled edges, where the cuff of the glove is seated during assembly. This, primarily, keeps the glove in place on the ring during packaging and shipping with nothing more than its own elasticity. It also plays a key roll in the functioning of the device. The angled circumference of the tapered sidewall allows the rings to stack for easy packaging. A pair will fit together easily in a belt-pack or sheath for quick and easy access. The angle also assists with easy glove detachment. The interior and exterior sizes of the sidewall openings must be just wide enough to fit over a large hand and far enough over the forearm for the glove to detatch.

It should be understood that in assembly, the cuff of the glove would be slipped over the ring to the ring's top until the finger openings of the glove are flush with the bottom edge of the ring. The cuff of the glove would then be evenly rolled back clockwise until perfectly seated in the ring's groove. This is how the product would be, preferably, received by the consumer.

Note FIGS. 5, 6, and 7 for an explanation of the inventive way of donning elastic gloves in accordance with the present invention. To utilize the present invention:

(A) Firmly grip over the cuff and groove with your thumb lined up with the arrow. The arrow is already lined up with the thumb of the glove during assembly and for instant orientation. A firm, but no strenuous grip, will insure the glove will stay in place until release.

(B) Slide the opposite hand into the glove, aligning thumb with guide arrow. Pull back with your gripping hand as you push your opposite hand into the glove until you get a firm tight fit.

(C) Loosen your grip on the cuff and groove as you slide your hand back, catching it on the overhang. Using the overhang for grip, pull back until the glove separates from the ring.

(D) Slide the ring from your arm.

(E) You are done with one hand. Repeat the other hand.

The rings stack together for efficient packaging. Also, they can be conveniently carried in a custom sheath or belt-pack by professionals, particularly law enforcement, paramedics, etc. The rings can be recycled and can be placed back into the custom sheath or belt-pack after use as time permits, taken to the station, placed in a recycle bin, then returned to the manufacturer to be used again. The ringed gloves would also work well with a wall-mount or counter-top dispenser allowing convenient access for use by nurses or doctors in offices and emergency rooms. They are also good for general around-the-house use. Because they are easy to use, people will use them more frequently.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A glove donning system for facilitating the donning of elastic gloves in a rapid and convenient manner comprising, in combination:

a pair of elastic gloves, each glove having a distal end with four thin closed finger portions for receiving the fingers of user and a thin closed thumb portion for receiving the thumb of a user, each glove also having a proximal end with a cuff portion for receiving the wrist of a user, each glove having an intermediate portion between the distal and proximal ends for receiving the central part of a hand of a user including the palm and a back of a hand, the glove being fabricated of an elastic material selected from the class of elastic materials including plastic and rubber, natural and synthetic, and blends thereof, the glove adapted to stretch over the hand of a user during donning and to contract over the hand of a user after donning and while being worn;

a support ring having an upper edge of a first circumference and a lower edge of a second circumference less than that of the first circumference with a tapering oval sidewall between the upper and lower edges, the upper edge having an exterior major diameter of 4.25 inches and the lower edge having an exterior major diameter of 4.00 inches and the sidewall having a height of 1.25 inches;

a flange formed in the support ring extending outwardly from the upper edge, the flange adapted to act as a stop for the proximal edge of the glove with the intermediate portion in contact with the side wall during a primary positioning of the glove on the support ring prior to donning;

generally annular deformations formed contiguously in the side wall essentially midway between, and parallel with, the upper and lower edges, the deformations including a groove above and a projection below and forming an S-shaped cross sectional configuration in the side wall with a width of about 10 percent of the width of the wall, the deformations adapted to act as a locating guide for the proximal edge of the glove as it is rolled down during a secondary positioning of the glove on the support ring with the rolled up portion in the groove; and a plurality of similarly sized and shaped ramps formed in the side wall between the deformations and the lower edge, the ramps being at three equally space locations with a circumferential width of 0.25 inches, each ramp having a cross sectional configuration of a right triangle with its hypotenuse side being about half the height of the side wall and the longer side being vertical and the shorter side being horizontal, the ramps adapted to facilitate the retention of the glove on the support ring as well as its removal, the ring with the flange and projection and ramps being integrally fabricated of an essentially rigid material.

* * * * *